United States Patent [19]

Higashi et al.

[11] Patent Number: 4,658,590

[45] Date of Patent: Apr. 21, 1987

[54] STEAM TURBINE GOVERNOR SYSTEM AND METHOD OF CONTROLLING THE SAME

[75] Inventors: Toshihiko Higashi; Yasuhiro Tennichi, both of Hitachi, Japan

[73] Assignee: Hitachi, Ltd., Tokyo, Japan

[21] Appl. No.: 687,164

[22] Filed: Dec. 28, 1984

[51] Int. Cl.[4] ..... F01K 13/02

[52] U.S. Cl. ..... 60/660; 415/36

[58] Field of Search ..... 60/660; 415/36

[56] References Cited

U.S. PATENT DOCUMENTS 4,355,514 10/1982 Reifenberg ..... 60/660

4,461,152 7/1984 Tennichi et al. ..... 60/660

*Primary Examiner*—Allen M. Ostrager

*Attorney, Agent, or Firm*—Antonelli, Terry & Wands

[57] ABSTRACT

A steam turbine governor system including two governor electronic sections for producing a turbine valve opening command to control the opening of steam valves thereby controlling a flow of steam into the turbine in dependence upon a difference between an actual turbine speed and a target turbine speed and a target turbine load. One governor electronic sections is actually used for controlling the opening of the steam valves, while the other governor electronic section is a stand-by. A first value relating to the turbine speed acceleration rate based on the turbine valve opening command produced by each of the governor electronic sections is obtained so that the first values are obtained parallelly and independently of each other in the two governor electronic sections. Turbine valve opening commands produced by the respective governor electronic sections are compared with each other and produce a start signal when the difference between them exceeds a predetermined level. A second value relating to the turbine speed acceleration rate based on the actual turbine speed is obtained, and a majority logic is applied to the first values obtained by the two governor electronic sections and the second value. An abnormality of any of the governor electronic sections is obtained based on the result of application of the majority logic.

23 Claims, 5 Drawing Figures

FIG. 5

| | ABd | AL | BL | CL | AR | BR | CR | MJ1 | MJ2 | UCN1 | UCN2 | UCN3 | UCN4 | CR1 | CR2 | UND1 | UND2 | REMARK |
|---|---|---|---|---|---|---|---|---|---|---|---|---|---|---|---|---|---|---|
| 1 | 0 | X | X | X | X | X | X | X | X | X | X | X | X | X | X | 0 | 0 | NORMAL: NO SWITCHING |
| 2 | 1 | 1 | 0 | 0 | 0 | 0 | 0 | 0 | 0 | 1 | 0 | 0 | 0 | 1 | 0 | 1 | 0 | A ABNORMAL |
| 3 | 1 | 0 | 0 | 0 | 1 | 0 | 0 | 0 | 0 | 0 | 0 | 1 | 0 | 1 | 0 | 1 | 0 | A ABNORMAL |
| 4 | 1 | 0 | 1 | 0 | 0 | 0 | 0 | 0 | 0 | 0 | 1 | 0 | 0 | 0 | 1 | 0 | 1 | B ABNORMAL |
| 5 | 1 | 0 | 0 | 0 | 0 | 1 | 0 | 0 | 0 | 0 | 0 | 0 | 1 | 0 | 1 | 0 | 1 | B ABNORMAL |
| 6 | 1 | 1 | 0 | 1 | 0 | 0 | 0 | 1 | 0 | 0 | 1 | 0 | 0 | 0 | 1 | 0 | 1 | B ABNORMAL |
| 7 | 1 | 0 | 1 | 1 | 1 | 0 | 0 | 1 | 0 | 1 | 0 | 1 | 0 | 1 | 0 | 1 | 0 | A ABNORMAL |
| 8 | 1 | 0 | 1 | 1 | 0 | 0 | 0 | 1 | 0 | 1 | 0 | 0 | 0 | 1 | 0 | 1 | 0 | A ABNORMAL |
| 9 | 1 | 1 | 0 | 1 | 0 | 1 | 0 | 1 | 0 | 0 | 1 | 0 | 1 | 0 | 1 | 0 | 1 | B ABNORMAL |
| 10 | 1 | 0 | 0 | 0 | 1 | 0 | 1 | 0 | 1 | 0 | 0 | 0 | 1 | 0 | 1 | 0 | 1 | B ABNORMAL |
| 11 | 1 | 1 | 0 | 0 | 0 | 1 | 1 | 0 | 1 | 1 | 0 | 1 | 0 | 1 | 0 | 1 | 0 | A ABNORMAL |
| 12 | 1 | 0 | 0 | 0 | 0 | 1 | 1 | 0 | 1 | 0 | 0 | 1 | 0 | 1 | 0 | 1 | 0 | A ABNORMAL |
| 13 | 1 | 0 | 1 | 0 | 1 | 0 | 1 | 0 | 1 | 0 | 1 | 0 | 1 | 0 | 1 | 0 | 1 | B ABNORMAL |
| 14 | 1 | 1 | 1 | 0 | 0 | 0 | 0 | 1 | 0 | 0 | 0 | 0 | 0 | 0 | 0 | 0 | 0 | NO SWITCHING (C ABNORMAL) |
| 15 | 1 | 0 | 0 | 0 | 1 | 1 | 0 | 0 | 1 | 0 | 0 | 0 | 0 | 0 | 0 | 0 | 0 | NO SWITCHING (C ABNORMAL) |
| 16 | 1 | 0 | 1 | 0 | 1 | 0 | 0 | 0 | 0 | 0 | 1 | 1 | 0 | 1 | 1 | 1 | 1 | ALTERNATE SWITCHING |
| 17 | 1 | 1 | 0 | 0 | 0 | 1 | 0 | 0 | 0 | 1 | 0 | 0 | 1 | 1 | 1 | 1 | 1 | ALTERNATE SWITCHING |
| 18 | 1 | 1 | 1 | 1 | 0 | 0 | 0 | 1 | 0 | 0 | 0 | 0 | 0 | 0 | 0 | 0 | 0 | NO SWITCHING (NORMAL) |
| 19 | 1 | 0 | 0 | 0 | 1 | 1 | 1 | 0 | 1 | 0 | 0 | 0 | 0 | 0 | 0 | 0 | 0 | NO SWITCHING (NORMAL) |

STEAM TURBINE GOVERNOR SYSTEM AND METHOD OF CONTROLLING THE SAME

BACKGROUND OF THE INVENTION

The present invention relates to a governor system and control method of a duplex steam turbine for a nuclear power plant and, a thermal power plant, or more particularly to a steam turbine governor system comprising a pair of governors for regulating the openings of turbine steam valves by a one-standby dynamic redundancy system, in which an abnormal one of the governors can be accurately discriminated by a simple device and function in the case where the difference between the output control signals of the governors exceeds a predetermined value.

A construction of the electro-hydraulic governor of the steam turbine with a pair of digital computers in duplex system is proposed in U.S. Pat. No. 4,153,198, wherein, even if one of the computers malfunctions, the turbine continues a normal operation by using the other computer, thereby assuring a high operating efficiency or high reliability. By virtue of these advantages, the system of the patent is broadly applied to various plants.

However, disadvantages of this system reside in the fact that it is difficult to determine which computer is to be used for regulating the turbine. Although each computer in the system is provided with a self-check system for detecting an abnormality or malfunction in hardware or software, if any, and change, upon detection of abnormality of one of the computers, the connection to the other computer for continued operation, it is still difficult in some cases to judge the abnormality or malfunction. For example, the two computers always execute the same process and produce respective outputs on the basis of the same inputs, and the turbine is driven by selected one of the outputs. Therefore, the two outputs must normally assume the same value. However, it is possible for the outputs to differ more than a tolerable range, while no abnormality is detected by the self-check function, although one of the computers must be abnormal or malfunctioning.

Under the above noted circumstances, it is necessary to provide an additional measure self check system for descriminating which of the outputs is correct. A well-known method of solution of this problem is to provide three computers which are used on the two-output-of-three basis, however, such a method results in high costs.

SUMMARY OF THE INVENTION

The object of the present invention is to provide a steam turbine governor system of one-governor-standby dynamic switching mode comprising a simple discriminating circuit for discriminting, when the outputs of the governor in operation and the stand by governor develop a great difference, which of the governors is normal to thereby assure correct changeover of the governors for selecting the normal governor.

The governor system according to the present invention comprises a monitor circuit for performing a simple calculation independently of the governor functions, while each of the governors is provided with the same calculating function so that upon an occurrence of a difference between the outputs of the two governors which are functionally the same for making up a one-standby dynamic redundancy system, a simple computation such as, for example, the computation of the acceleration rate of the turbine speed, is assigned to the governors and the monitor circuit, and one of governors which is selected by the majority logic of the computation results of the three is validated for operating the system.

BRIEF DESCRIPTION OF THE DRAWINGS

FIG. 5 is a truth table illustrating a manner in which one of the computers is selected under various conditions of the signals produced from the elements illustrated in FIGS. 3 and 4.

DETAILED DESCRIPTION

Figure 1:
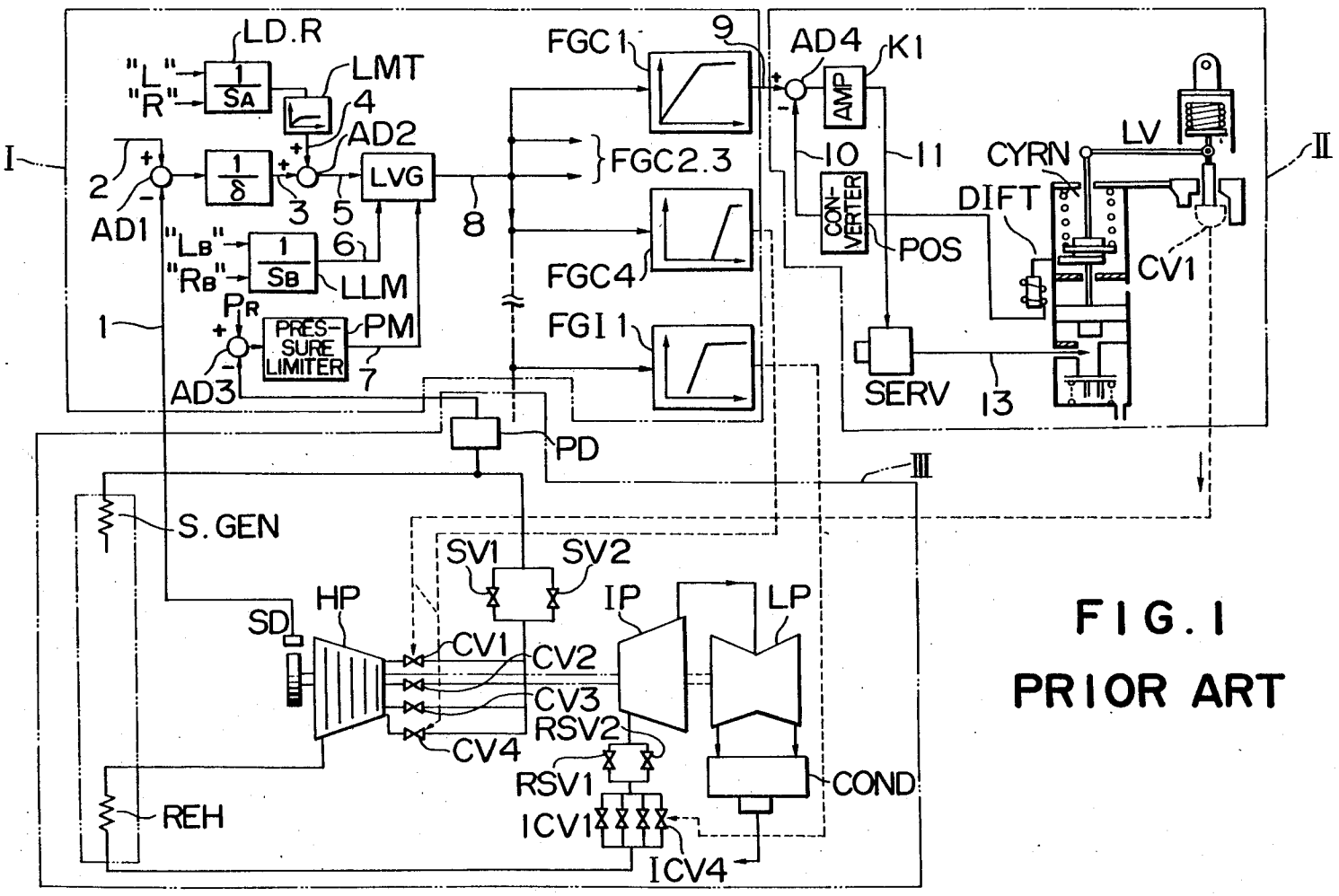
FIG. 1 PRIOR ART
FIG. 1 is a schematic view of a conventional construction of a thermal power plant and an electrohydraulic turbine control system.

Referring now to the drawings wherein like reference numerals are used throughout the various views to designate like parts and, more particularly, to FIG. 1, according to this Figure, an electronic hydraulic governor applied to a reheat steam turbine used in a thermal power plant connected with a turbine steam system will be described in two groups, one group including sections I and II constituting an electronic hydraulic governor system and the other a steam system III including a steam generator and a turbine.

In the steam system III, the steam, generated in a steam generator S.GEN, is supplied to a high-pressure turbine HP through steam stop valves SV1, SV2 and steam control valves CV1 to CV4.

The steam worked in the high-pressure turbine HP is reduced in enthalpy. In order to improve the efficiency of the power plant, the steam is reheated in a reheater REH in the steam generator S.GEN. The steam thus increased in enthalpy by the reheater REH is supplied through reheat steam stop valves RSV1, RSV2 and intermediate check valves ICV1 to ICV4 to intermediate- and low-pressure turbines IP/LP. The steam worked in the low-pressure turbine is condensed in a condenser COND, and the condensed water is returned to the steam generator S.GEN. The valves to be controlled by the governors, in a typical system, comprise, as shown, a pair of steam stop valves SV1 and SV2, four steam control valves CV1 to CV4, a pair of reheat steam stop valves RSV1 and RSV2, and four intermediate check valves ICV1 to ICV4. Under a normal operation mode excepting turbine acceleration or emergency stop, the steam stop valves SV1, SV2, the intermediate check valves ICV1 to ICV4 and the reheat steam stop valves RSV1, RSV2 are fully open, so that the flow rate of steam supplied from the steam generator S.GEN to the turbines HP, IL/LP is regulated only by the steam control valves CV1 to CV4.

In one of the methods of controlling the steam control valves CV1 to CV4 for regulating the steam flow rate, the valves CV1, CV2, CV3 and CV4 are opened successively in that order. In another steam valve control method, the valves are operated so as to reduce the stress of the turbine rotor.

The hydraulic governor systems acts as a main controller for controlling the opening of the above-mentioned steam valves and includes a section I forming a computerized electronic governor section and a section II formed as a mechanical hydraulic section. The basic function of the electronic governor section related to the turbine speed and load control will be described more fully hereinbelow.

A turbine speed signal 1 is obtained from an actual speed detector SD for detecting the number of revolutions of a gear mounted on the turbine shaft. The error between the speed signal 1 and a predetermined target turbine speed signal 2 is calculated by an arithmetic unit AD1. The detected error is multipled by $1/\delta$, with $\delta$ representing a regulation factor, and is added to th load setting signal 4 from the target load setter LD.REF at an adder AD2. A change rate regulator LMT is also provided.

When the actual turbine speed signal 1 is equal to the turbine target speed signal S REF, only the load setting signal 4 is applied to the succeeding stage of the control circuit as apparent from the foregoing description.

The load setting signal 4 is supplied from the change rate regulator LMT and the target load setter LD.R generally having an integration characteristic 1/SA as shown in FIG. 1. Furthermore, the target load setter LD.R receives load change commands "L", "R" from external devices (not shown) or manually by an operator.

The output signal 5 of the adder AD2 is applied to a lower-value priority circuit LVG of the next stage. In the example of FIG. 1, the output signal 6 of the load limiter LLM and the output signal 7 of the pressure limiter PM, together with the signal 5, are applied to the lower-value priority circuit LVG, so that the smallest of the signals 5, 6 and 7 is selected as an output signal of the lower-value priority circuit LVG and is used as a total steam flow demand signal 8 for regulating the openings of the steam valves.

Characters PD in FIG. 1 designate a main steam pressure detector, the output of which, together with the reference pressure signal PR, is applied to the arithmetic unit AD3. The output of the arithmetic unit AD3, that is, the error from the reference value of the main steam pressure is applied to the pressure limiter PM.

The load limiter LLM, as known, is provided for the purpose of preventing an unreasonable load from being imposed on the turbine by sudden opening of the steam valves in response to the signal 5, when the turbine speed is greatly reduced due to sharp increasing in load of the power system. Generally, the system is operated by setting the load limiter LLM such that the signal 6 is slightly larger than the signal 5 when the speed error signal 3 is zero.

The function of the pressure limiter PM, as known, is to close the turbine steam control valves CV1 to CV4 when the pressure of steam imparted from the steam generator S.GEN to the turbine is reduced by a fault or malfunctioning of the steam generator S.GEN or a control device thereof, thereby facilitating restoration of the reduced steam pressure.

Function generators FGC1 to FGC4 and FGI1 of FIG. 1 control the openings of the steam control valves CV1 to CV4, the intermediate check valves ICV1 to ICV4 and the steam stop valves SV1 to SV2 in response to the total steam flow demand signal 8.

In, for example, a turbine operating system in which the four steam control valves CV1 to CV4 are sequentially opened to increase the steam flow rate, a large output is produced from the function generator FGC1 for opening the first control valve CV1 designated to be opened, while the output of the function generator FGC4 is zero for not opening the last control valve CV4 designated to be opened when the total steam flow demand signal 8 is small.

Now, the hydraulic section II will be explained. The mechanism (the part defined by two-dot chains in FIG. 1) and the technique for controlling the opening of the steam valve by the output of any of the function generators FGC1 to FGC4 and FGI1 apply similarly to all the function generators. Therefore, the explanation thereof will be made with reference only to the function generator FGC1.

An electric-hydraulic signal converter SERV converts an electric signal output 11 of an amplifier K1 to an oil amount control signal 13, which, in, is used to supply the working oil in an amount corresponding to the signal 13 to the cylinder CYRN. As a result, the piston in the cylinder CYRN causes a stroke (displacement) proportional to the amount of the working oil. This stroke (displacement) is transmitted through a mechanical level LV to the steam control valve CV1 to thereby control the opening thereof. The stroke of the piston in the cylinder CTRYN is detected by a detector DIFT, and the signal produced from the detector DIFT is applied through a converter POS to an arithmetic unit AD4 as a feedback signal. The valve opening target signal 9 which is produced from the function generator FGC1 is also applied to the arithmetic unit AD4. The output of the arithmetic unit AD4, that is, an error signal representing the difference between the actual opening of the steam control valve CV1, given by the signal 10, and the valve opening target signal 9 is amplified by the amplifier K1, and then supplied to the electro-hydraulic signal converter SERV. In other words, the actual opening of the steam control valve CV1 is controlled to coincide with the valve opening target signal 9 by the mechanism enclosed by two-dot chains in FIG. 1.

As explained above, a minor control loop including the arithmetic unit AD4, the electro-hydraulic signal converter SERV, cylinder CYRN, detector DIFT, converter POS and the arithmetic unit AD4 connected in that order is provided additionally to a major control loop including the valve opening target signal 9, the change in the steam valve openings, changes in the amount of steam in turbine rotor, change in turbine speed, speed error and the function generator FGC1, for compensating for the generally large time delay of the major loop and securing fast response of steam valve opening control thereby to stabilize the valve openings.

Figure 2:
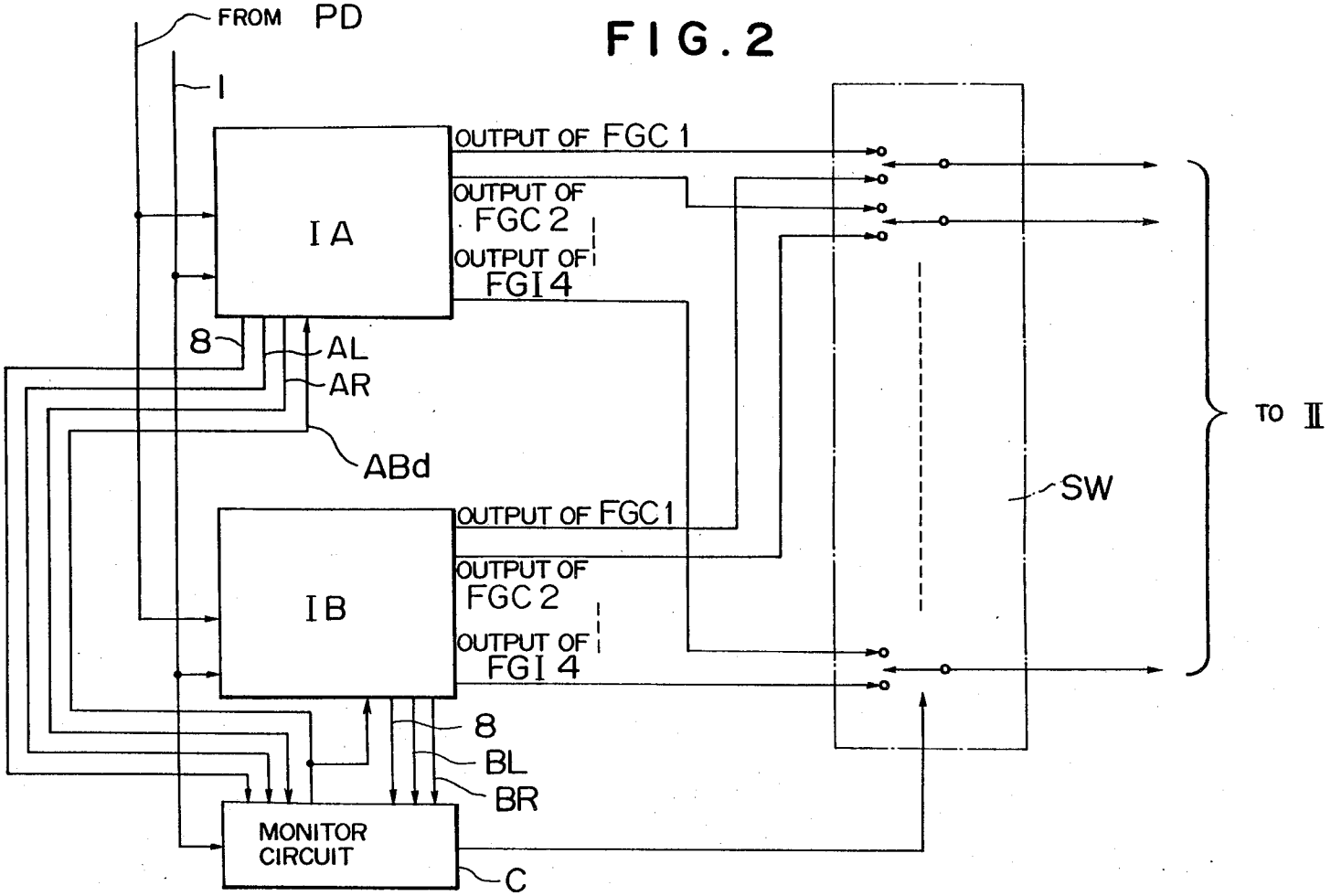
FIG. 2 is a schematic diagram of a duplex system according to the present invention for signal selection by a monitor means.

As shown in FIG. 2, in accordance with the present invention, two sets of computerized electronic sections IA, IB are provided and commonly receive the turbine speed signal 1 and the output of the turbine inlet pressure detector PD. Each of the electronic sections IA, IB produces opening command signals for the turbine control valves CV1 to CV4 and ICV1 to ICV4, respectively, so that two opening command signals are produced for each of the valves. The command signals derived from one of the sections IA, IB are selected by the switch SW, and applied to the hydraulic section II. The switch SW may be initially set to receive the outputs derived from any one of the governor sections IA and IB, the operation of the switch SW is carried out thereafter according to an output from a monitor C as described hereinafter. The hydraulic section II is not constructed in duplex system unlike the electronic section. The monitor C is added according to the present invention, which receives the output signal 8 of the lower-value gate LVG (total steam flow demand signal for the turbine control valves), an acceleration signal AR or BR, and a deceleration signal AL or BL from each of the sections IA, IB and produces a starting signal ABd in a manner as described below. The signal ABd is applied to the electronic sections IA, IB.

Figure 3:
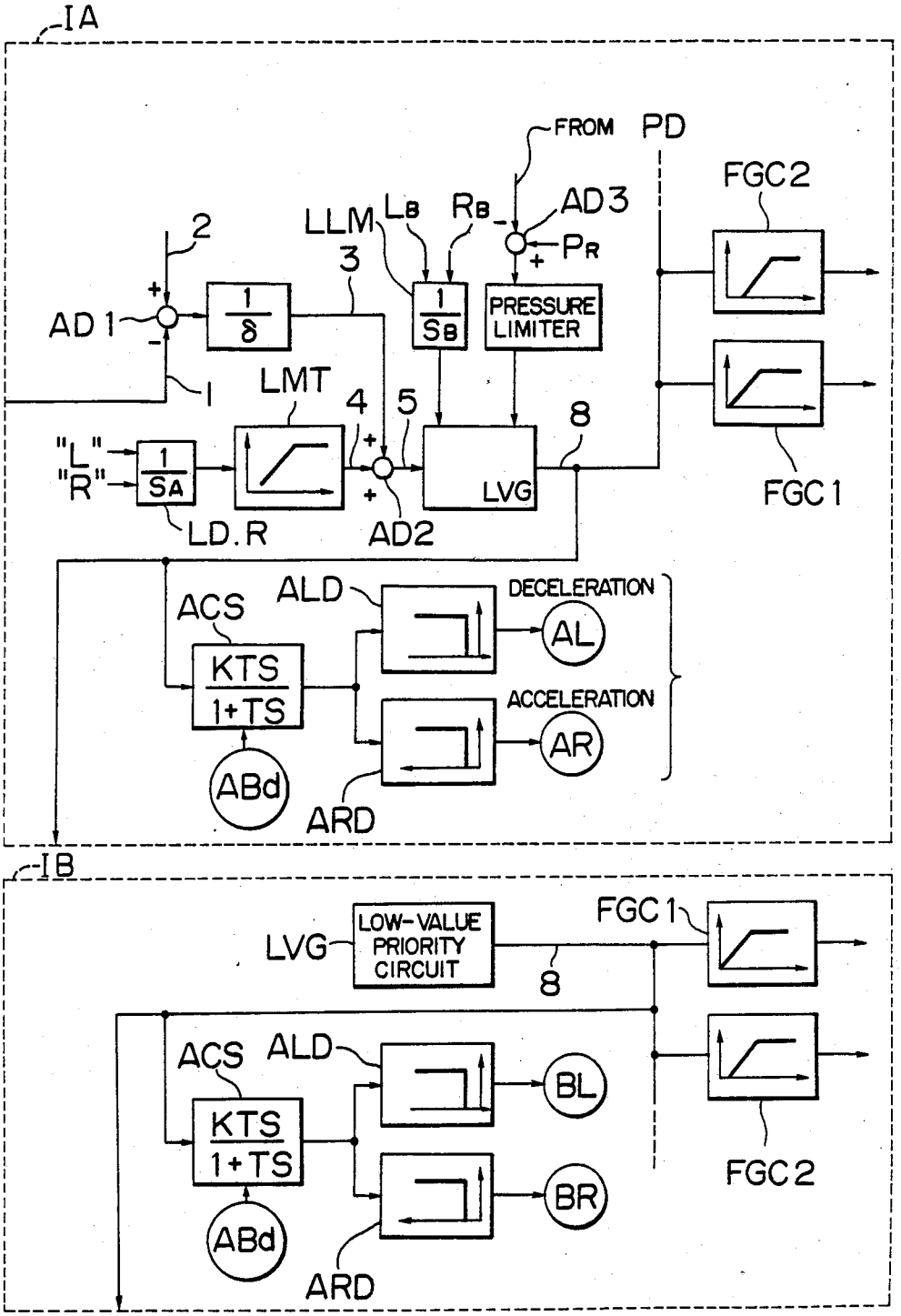
FIG. 3 is a schematic view calculating sections respectively attached to the governor computers, of the duplex system.

FIG. 3 shows the components of the electronic sections IA, IB, in which the circuits ACS, ALD and ARD are added according to the present invention for processing the common valve opening command signal in response to the starting signal ABd. Except for these additional circuits, the electronic sections IA, IB are configured the same manner as in FIG. 1.

Figure 4:
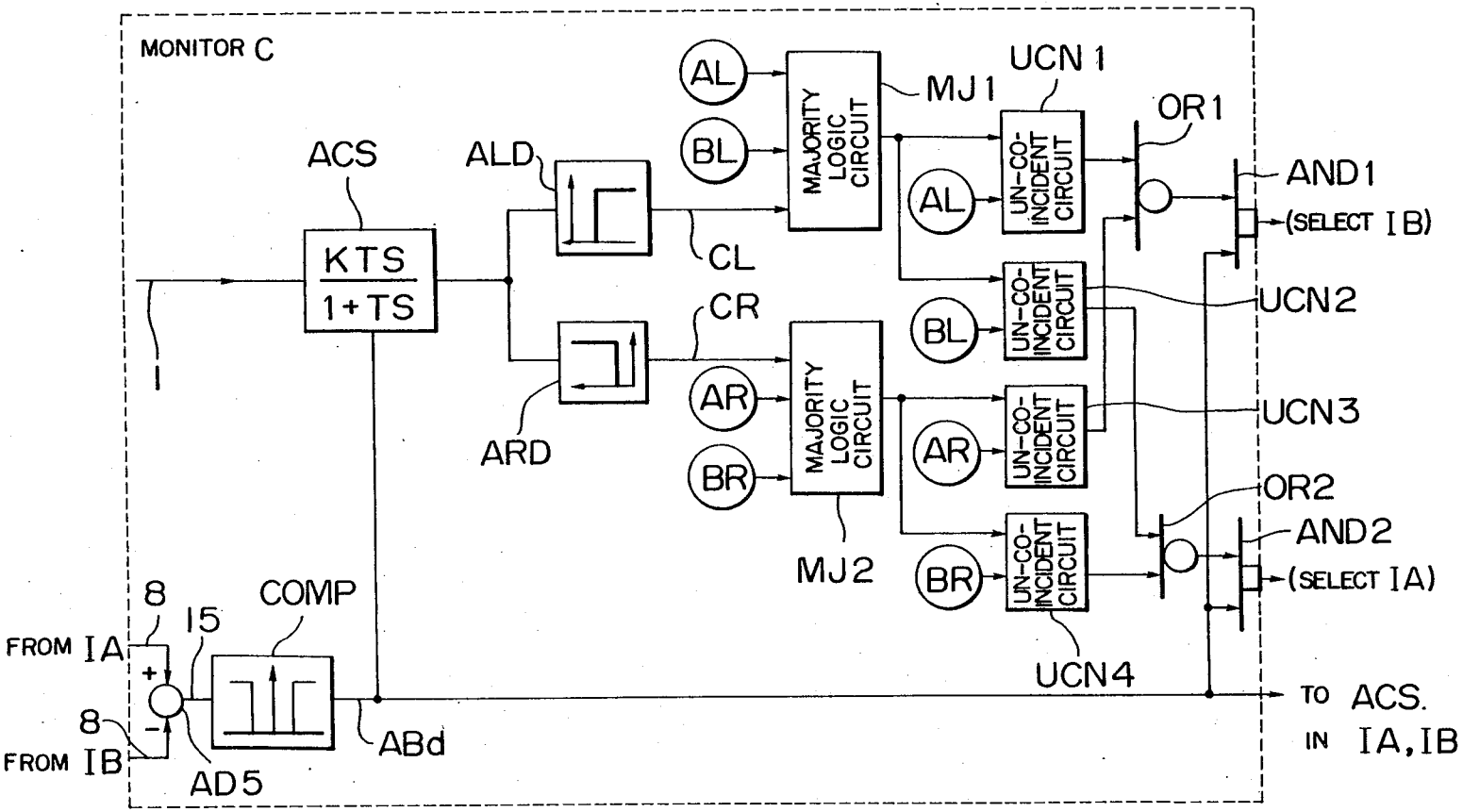
FIG. 4 is a schematic view of the monitor means of the present invention.

The operation of the monitor C is most clearly shown in FIGS. 3 and 4. More particularly, as shown in FIG. 4, the total steam flow demand signals 8, which are produced independently by the sections IA, IB, respectively, for determining the openings of the turbine control valves, i.e., the most important variables for control of operation of the system, are applied to the arithmetic unit AD5 for comparison. The arithmetic unit AD5 produces a difference between two signals 8, which is applied to a comparator COMP. If the difference is larger than, for example, 2% of a full scale value representing 100% output of the steam turbine, the comparator COMP produces a logic output "1" (which is the start signal ABd). The signal 8 may be replaced by another signal such as the output signal of the function generator FGC.

In response to the logic output "1" (starting signal ABd) produced by the comparator COMP, the turbine acceleration rate calculator ACS, provided for each of the governor sections IA, IB as shown in FIG. 3, processes the total steam flow demand signal 8 applied thereto to compute the turbine acceleration rate on the basis of the change in the signal 8. The calculator ACS functions as differentiator to provide a time-variation rate represented by a function of $$\frac{KTS}{1 + TS}$$

in change of the signal 8. That is, the calculator ACS provides an output of zero when the input signal 8 is constant and provides an incomplete differential output in response to the step-wise change of the input signal, while provides, when the input is a ramp-wise signal, an output of constant level corresponding to the gradient of the ramp signal.

The result of the computation, in each governor section IA or IB, is applied to the acceleration decision means ARD and the deceleration decision means ALD. When the result of computation exceeds a predetermined acceleration or deceleration rate larger than zero, the acceleration decision means ARD or the deceleration decision means ALD produces a deceleration signal AL, BL or an acceleration signal AR, BR, respectively.

As apparent, the acceleration or deceleration computation in the governor sections IA, IB may be executed not only when the starting signal ABd is generated from the comparator COMP but also when the logic output is not produced.

Now, the operation of the monitor circuit C with the starting signal ABd produced from the comparator COMP will be explained.

As shown in FIG. 4. The starting signal ABd is supplied to the logic product gates AND1 and AND2, and to the turbine acceleration rate calculator ACS provided to the monitor circuit C. The turbine acceleration rate calculator ACS calculates the acceleration rate based on the actual turbine speed signal 1 measured by the speed detector SD (FIG. 1). The acceleration rate is obtained based on the total stream flow demand signal 8 in each of the governor sections IA, IB, while obtained based on the turbine speed signal 1 in the monitor C. It would be more exact to obtain the acceleration rate based on the total steam flow demand signal 8 in the monitor C, too. However, such arrangement requires a more complicated structure of the monitor. For this reason, and also because it is enough for the present invention to detect whether any one of the governor sections IA, IB is abnormal or malfunctioning, the monitor C is arranged to monitor the turbine speed signal 1. This arrangement is effective to make the structure of the monitor less complicated, while satisfactorily detecting an abnormality or malfunctioning of any of the governor sections IA, IB.

The result of this calculation is applied to the acceleration decision means ARD and the deceleration decision means ALD, which are configured in the same manner as those of the governor sections IA, IB mentioned above, and produce the acceleration signal CR or the deceleration signal CL.

The acceleration signal CR and the deceleration signal CL, if any, are applied to first and second 2-out-of-3 logic circuits (generally, majority logic circuits) MJ1 and MJ2, respectively, which also receive the acceleration signal AR, BR or deceleration signal AL, BL from the sections. The 2-out-of-3 logic circuit MJ1 or MJ2 produces an output "1" when at least two the three inputs are both "1".

The output of the first 2-out-of-3 logic circuit MJ1 is applied to the first and second non-coincidence circuits UCN1 and UCN2, while the output of the second 2-out-3 logic circuit MJ2 is applied to the third and fourth non-coincidence circuits UCN3 and UCN4.

Further, the first non-coincidence circuit UCN1 is supplied with the deceleration signal AL from the governor section IA, the second non-coincidence circuit UCN2 with the deceleration signal BL from the governor section IB, the third non-coincidence circuit UCN3 with the acceleration signal AR from the governor IA, and the fourth non-coincidence circuit UCN4 with the acceleration signal BR from the governor section IB.

The outputs of the first and third non-coincidence circuits UCN1 and UCN3 are applied to the first logic OR gate OR1, while the outputs of the second and fourth non-coincidence circuits UCN2 and UCN4 are applied to the second logic OR gate OR2.

The output of the first logic sum gate OR1 is applied to the first logic AND gate AND1, while the output of the second logic sum gate OR2 is applied to the second logic AND gate AND2.

As apparent from the description below, a logic output "1" is produced from the first AND gate AND1 when the governor section IA is abnormal, while a logic output "1" is produced from the second AND gate AND2 when the governor section IB is abnormal.

In the truth table for the monitor C of FIG. 5, the symbol X indicates the signals "1" or "0" have no effect on the result of logic operation (outputs of the AND gates AND1, AND2).

Now, several representative operational examples of the monitor circuit C of FIG. 4 will be explained with reference to FIG. 5.

Example 1: There is no substantial error between the two signals.

When there is only a small difference between the total steam flow demand signals 8 produced from the governor sections IA, IB, and, therefore, the output of the comparator COMP (FIG. 3) is "0", that is, the starting signal ABd is "0", the outputs of the two AND gates AND1 and AND2 are both "0" regardless of the outputs of the acceleration decision means ARD and the deceleration decision means ALD. Under this condition, it is decided that the governor sections IA, IB are normal and therefore no switching of the governor sections is required.

Examples 2 to 5: In spite of neither acceleration or deceleration being detected by the monitor circuit C, the governor section IA or IB detects an acceleration or deceleration, respectively.

Example 3 will be explained as a typical example. This example indicates the starting signal ABd of "1", the deceleration signal of the governor section IA of "1", and the acceleration and deceleration signals CR and CL of the monitor circuit C being both "0". In other words, this is a situation in which the turbine should be decelerated according to the signal 8 of the governor section IA, but actual turbine speed is not increased or decreased, and the governor IA must operate abnormally.

In this situation, the outputs of both the first and second 2-out-of-3 logic circuits MJ1 and MJ2 are "0", and the third non-coincidence circuit UCN3 alone produces a "1" output. As a result, the outputs of the first OR gate OR1 and the first AND gate AND1 are both "1".

It is thus decided that the governor section IA is abnormal, and if the governor section IA is incorporated in the control system, the connection is switched to replace it by the governor section IB. In the other examples 2, 4 and 5, it is decided that the governor section in which an acceleration or deceleration is detected is abnormal.

Examples 6, 8, 10 and 12: The monitor C detects acceleration or deceleration, while one of the governor sections IA or IB detect a speed change in the same direction.

In example 6, the starting signal ABd is "1", the governor section IB produces neither the acceleration signal AR nor deceleration signal AL, the deceleration signal AL of the governor section IA is "1", and the deceleration signal CL of the monitor circuit C is "1". In other words, this represents a situation wherein the turbine should not be accelerated or decelerated with the signal 8 of the governor section IB, but the actual turbine speed is decreased, and therefore the governor section IB is not normal. On the other hand, the signal 8 of the governor section IA should invite deceleration of the turbine and the governor section IA operates normally.

In this situation, only the outputs of the first 2-out-of-3 logic circuit MJ1 and the second non-coincidence circuit UCN2 are "1". As a result, the outputs of the second OR gate OR2 and the second AND gate AND2 are "1", so that it is decided that the governor section IB is abnormal. In examples 8, 10 and 12, the governor section which has detected a speed change, is considered abnormal.

Examples 7, 9, 11 and 13: The monitor C detects a speed change, while the governor sections IA and IB detect speed changes in different direction.

This is a situation wherein, when the starting signal ABd is "1", the acceleration signal BR of the governor section IB and the deceleration signal AL of the governor section IA are both "1", and the deceleration signal CL of the monitor circuit is "1". In other words, although the turbine should be accelerated according to the signal 8 of the governor section IB, the actual turbine speed is decreased, so that the governor section IB is abnormal, while the governor IA is normal.

In this situation, the output of the first 2-out-of-3 logic circuit MJ1 is "1", and the outputs of both the second and fourth non-coincidence circuits UCN2 and UCN4 are also "1". As a result, the outputs of both the second OR gate OR2 and the second AND gate AND2 are "1", so that it is decided that the governor section IB is abnormal. In the examples 9, 11 and 13, the governor section which has detected speed change in the direciton opposite to that detected by the monitor is considered abnormal.

Examples 14 and 15: The monitor detects no speed change, while both the governor sections IA and IB detect a speed change in the same direction.

Example 14 will be explained as a typical example. Both the governor sections IA and IB detect a deceleration. This apparently indicates that the monitor C is abnormal, and it is not necessary to switch the control. In this case, the output of the first 2-out-of-3 logic circuit MJ1 is "1", and the output of the second 2-out-of-3 logic circuit MJ2 is "0". The outputs of all the non-coincidence circuits UCN1 to UCN4, which compare the output of MJ1 with AL or BL and the output of MJ2 with AR or BR, are "0", so that the outputs of AND gates AND1, AND2 are "0". Thus, no switching occurs and the operation is continued as before. In this situation, although the abnormality of the monitor C cannot be detected by the circuit of FIG. 4, it will be easy to detect it by providing the circuit with a suitable logic satisfying AL=BL=1 and CL=0. This also applies to the case 15, in which the operation is continued in example of the monitor C being abnormal.

Examples 16 and 17: The monitor C detects no speed change, while the governor sections IA and IB detect an acceleration and deceleration, or a deceleration and acceleration respectively.

In example 16, the governor section IA detects acceleration while the governor section IB detects deceleration. In this very rare situation, if any, the outputs of the first and second 2-out-of-3 logic circuits are "0", and the outputs of the non-coincidence circuits UCN2 and UCN3 are both "1". As a result, both the outputs of the circuits OR1 and OR2 are "1", so that the switch SW may be turned between IA and IB alternately, causing an unstable state. No measure againt this trouble is necessary, however, since such a situation, though conceivable, cannot actually occur. Nevertheless, if such a trouble is to be avoided, any measure may be taken for blocking the outputs of the switch circuit SW or stopping the operation of the turbine control by detection of such combinations of the signals (AL, BL, CL, AR, BR, CR) as those in cases 16 and 17.

Examples 18 and 19: The outputs of all the governor sections IA, IB and monitor circuit C indicate speed change in the same direction.

This situation occurs when the governor sections IA, IB and the monitor C all function normally during speed change, so that the operation is continued without switching the governor sections.

As will be easily understood from the foregoing explanation of the operation and FIG. 5, the monitor circuit of FIG. 4 performs the logic operation as mentioned below to determine an abnormal governor.

(1) A majority logic is applied to the acceleration signals AR, BR, CR and the deceleration signals AL, BL, CL independently calculated to select two out of the three signals, thereby producing an output corresponding to the selected signals.

(2) An acceleration signal and/or a deceleration signal which fails to coincide with the output of the majority logic is detected and it is decided that the governor section which generates the non-coincident acceleration or deceleration signal is abnormal.

It will be seen from the above description that according to the present invention, the possibility of detection of abnormality in the governor sections IA, IB greatly affecting the reliability of the electronic/hydraulic governor system of one-standby redundancy system is improved to more than 99% by providing a simple monitor circuit C, although the detection possibility in the conventional system has so far been about 95% or near.

Consequently, MTBF (mean time between failures), for example, can be increased by about 50%.

An additional cost of less than 5% is required for providing the acceleration or deceleration decision means of FIG. 3 and the monitor circuit of FIG. 4 as compared with provision of the conventional governor sections, but it is believed that the improvement in reliability is sufficiently profitable more than the additional cost.

Although the monitor circuit and the two governor sections IA and IB are arranged to calculate the acceleration rate in the above-described embodiment, they may be arranged to calculate other appropriate factors such as turbine load alternatively.

The reason why the acceleration rate is calculated in the aforementioned embodiment is as follows:

(1) The acceleration rate is an index relating to the speed signal important for the turbine.

(2) Since the turbine speed signal is used for the calculation, there is no need of any new detector, thus allowing effective utilization of the existing detector.

What is claimed is:

1. A governor system for a steam turbine having a valve means for controlling an amount of steam supplied to the turbine, said governor system comprising two electronic sections each producing a target opening signal for said valve means based on a turbine operation signal relating to an operation of the turbine and commonly applied to both of said two electronic sections, means for selecting one of the target opening signals produced by said electronic sections to be used for controlling the opening of said valve means, means for computing a first value representative of a parameter relating to the operation of the turbine as a predetermined function of said turbine operation signal, means provided for each of said electronic sections for coputing a second valve representative of the same parameter as that represented by said first value which would be obtained if said valve means is controlled by the target opening signal produced by the electronic section associated with the valve means, and means for producing a selection signal on the basis of said first value and said second value produced by said second value computing means provided to said two electronic sections, respectively, said selection signal being applied to said selecting means for determining which of said target opening signals should be selected by said switching means.

2. A governor system according to claim 1, wherein said parameter is a turbine speed.

3. A governor system according to claim 1, wherein said parameter is a turbine load.

4. A governor system according to claim 1, wherein said turbine operation signal is a signal representing an actual turbine speed.

5. A governor system according to claim 2, wherein said turbine opration signal is a signal representing an actual turbine speed.

6. A governor system according to claim 1, wherein said selection signal producing means is rendered effective when the difference between said target opening signal produced by said two sections is greater than a predetermined value.

7. A governor system according to claim 1, wherein said selection signal producing means includes means for determining as normal one of said two sections which produces said second value the same as said first value.

8. A governor system for a steam turbine, having valve means for controlling an amount of steam supplied to the turbine, said governor system comprising two electronic sections each producing a target opening signal for said valve means based on a turbine speed signal representing an actual turbine speed, means for selecting one of the target opening signals produced by said electronic sections to be used for controlling the opening of said valve means, means for computing a first value representative of a parameter relating to the turbine speed as a predetermined function of said turbine speed signal, means provided for each of said electronic sections for computing a second value representative of the same parameter as that represented by said first value which would be obtained if said valve means is controlled by the target opening signal produced by the electronic section associated with the valve means, and means operative when the difference between said target opening signals produced by said two electronic sections is greater than a predetermined value for producing a selection signal on the basis of said first value and said second value produced by said second value computing means provided to said two electronic sections, respectively, said selection signal being applied to said selecting means for determined which of said target opening signals should be selected by said switching means.

9. A governor system according to claim 8, wherein said parameter represents the direction in change of the turbine speed.

10. A governor system according to claim 8, wherein said selection signal producing means includes means for determining as normal one of said two electronic sections which produces said second value the same as said first value.

11. A governor system for a steam turbine having valve means for controlling an amount of steam supplied to the turbine, said governor system comprising two electronic sections each producing a total steam flow demand signal based on a turbine operation signal relating to the operation of the turbine and commonly applied to both of said two electronic sections and producing a target opening signal for said valve means based on said total steam flow demand signal, means for selecting one of the demand signals produced by said electrnoic sections for controlling the opening of said valve means, means for computing a first value representative of a parameter relating to the operation of the turbine as a predetermined function of said turbine operation signal, means provided to each of said electronic sections for computing a second value representative of the same parameter as that represented by said first value which would be obtained if said valve means is controlled by the demand signal produced by the electrnoic section associated with the valve means, and means for producing a selection signal on the basis of said first value and said second value produced by said second value computing means provided to said two electronic sections, respectively, said selection signal being applied to selecting means for determining which of said demand signals should be selected by said switching means.

12. A governor system according to claim 11, wherein said parameter is a turbine speed.

13. A governor system according to claim 11, wherein said parameter is a turbine load.

14. A governor system according to claim 11, wherein said turbine operation signal is a signal representing an actual turbine speed.

15. A governor system according to claim 12, wherein said turbine opration signal is a signal representing an actual turbine speed.

16. A governor system according to claim 11, wherein said selection signal producing means is rendered effective when the difference between said target opening signal produced by said two sections is greater than a predetermined value.

17. A governor system according to claim 1, wherein said selection signal producing means includes means for determining as normal one of said two sections which produces said second value the same as said first value.

18. A governor system for a steam turbine, having valve means for controlling an amount of steam supplied to the turbine, said governor system comprising two electronic sections each producing a total steam flow demand signal based on a turbine speed signal representing an actual turbine speed and producing a target opening signal for said valve means based on said total steam flow demand signal, means for selecting one of the demand signals produced by said electrnoic sections for controlling the opening of said valve means, means for computing a first value representative of a parameter relating to the turbine speed as a predetermined function of said turbine speed signal, means provided to each of said electronic sections for computing a second value representative of the same parameter as that represented by said first value which would be obtained if said valve means is controlled by the demand signal produced by the electronic section associated with the valve means, and means operative when the difference between said demand signals is produced by said two electronic sections is greater than a predetermined value for producing a selection signal on the basis of said first value and said second value produced by said second value computing means provided to said two electronic sections, respectively, said selection signal being applied to said selecting means for determined which of said demand signals should be selected by said switching means.

19. A governor system according to claim 18, wherein said parameter represents the direction in change of the turbine speed.

20. A governor system according to claim 18, wherein said selection signal producing means includes means for determining as normal one of said two electronic sections which produces said second value the same as said first value.

21. A method for controlling a governor system for a steam turbine comprising two governor electronic sections one of which is actually used for controlling valve means of the turbine and the other governor electronic section is used as a stand-by of said one governor electronic section, the controlling method comprising the steps of:

producing a turbine valve opening command adapted to control the opening of said valve means on the basis of a difference between an actual turbine speed and a target turbine speed and a target turbine load, parallelly in each of said governor electronic sections and independently on each other, obtaining a first value relating to a turbine speed acceleration rate based on the turbine valve opening command produced by each of said two governor electronic sections, respectively, said computation being carried out parallelly in said two governor electronic sections, comparing the turbine valve opening commands produced by said two governor electronic sections, respectively, and producing a start signal when a difference between said commands exceeds a predetermined level, obtaining a second value relating to the turbine speed acceleration rate based on the actual turbine speed, applying a majority logic to said first values obtained in said governor electronic sections and said second value, determining an abnormality of any of said governor electronic sections based on the result of application of said majority logic, and inhibiting the determination of abnormality when said starting signal is not produced.

22. A method according to claim 21, wherein the steps of obtaining said first and second values are started in response to said starting signal.

23. A method according to claim 21, wherein the governor electronic section which produces said first value not agreement with the result of application of said majority logic is determined as abnormal.

* * * * *